US010188231B2

(12) United States Patent
Hung

(10) Patent No.: US 10,188,231 B2
(45) Date of Patent: Jan. 29, 2019

(54) FLEXIBLE MEMBRANE DRINKING CUP LID

(71) Applicant: Michael Hung, Hong Kong (HK)

(72) Inventor: Michael Hung, Hong Kong (HK)

( * ) Notice: Subject to any disclaimer, the term of this patent is extended or adjusted under 35 U.S.C. 154(b) by 0 days.

(21) Appl. No.: 15/586,625

(22) Filed: May 4, 2017

(65) Prior Publication Data

US 2018/0317684 A1 Nov. 8, 2018

(51) Int. Cl.

| | |
|---|---|
| ***A47G 21/18*** | (2006.01) |
| ***A47G 19/22*** | (2006.01) |
| ***B65D 51/32*** | (2006.01) |
| ***B65D 43/02*** | (2006.01) |

(52) U.S. Cl.

CPC ..... *A47G 21/181* (2013.01); *A47G 19/2266* (2013.01); *B65D 43/0204* (2013.01); *B65D 43/0225* (2013.01); *B65D 51/32* (2013.01)

(58) Field of Classification Search

CPC .. A47G 21/18–21/189; A47G 19/22–19/2266; B65D 43/00–43/0202; B65D 43/0225; B65D 43/0204–43/0222; B65D 51/32

USPC ..... 220/703–719, 592.16–592.19; 215/229, 215/387–389

See application file for complete search history.

(56) References Cited

U.S. PATENT DOCUMENTS

2006/0273094 A1* 12/2006 Cohen ..... A47G 19/02 220/780
2010/0308046 A1* 12/2010 Serra ..... A47G 19/2205 220/212
2013/0119065 A1* 5/2013 Buck ..... A47G 19/2205 220/523
2013/0126527 A1* 5/2013 Chiu ..... A47G 21/18 220/212
2013/0270264 A1* 10/2013 Suljak ..... A45C 11/20 220/4.03
2014/0103037 A1* 4/2014 Strominger ..... B65D 51/28 220/23.83
2016/0200486 A1* 7/2016 Meyers ..... A47G 19/2266 215/229

* cited by examiner

*Primary Examiner* — Kareen K Thomas
(74) *Attorney, Agent, or Firm* — Stephen E. Zweig

(57) ABSTRACT

A lid device for a beverage cup. The lid is a multi-component annular structure with an outer ring of rigid material that attaches to the cup. Inside the outer ring is an inner flexible material, often with a rigid or flexible central structure with an opening for a drinking straw. In an absence of applied force, this opening (and the straw) will be held substantially perpendicular to the top of the central structure and lid. The inner flexible material is selected to deform easily under mild hand pressure (e.g. 5 Newtons or less), and thus when the user applies force to the straw, the inner flexible material distorts and bends allowing the user to more easily move the straw around and mix the contents of the drink.

9 Claims, 5 Drawing Sheets

FLEXIBLE MEMBRANE DRINKING CUP LID

BACKGROUND OF THE INVENTION

Field of the Invention

This invention is in the field of lids for drinking cups.

Description of the Related Art

Users of beverage cups, particularly beverage cups with lids, often desire to use a drinking straw to play with their drinks, and stir ice cubes or other material in their drinks.

Previous workers in the field, such as Serra, in U.S. Pat. No. 8,794,822 have designed lids for such beverage cups with rotary disks designed to facilitate drink mixing.

BRIEF SUMMARY OF THE INVENTION

The invention comprises an improved lid for a beverage cup, typically an approximately cylindrical beverage cup. This lid can be a multi-component annular structure with an outer ring of rigid material that attaches to the cup. Inside the outer ring is an inner flexible material, often with a rigid or flexible central structure with an opening for a drinking straw. In an absence of applied force, this opening (and the straw) will be held substantially perpendicular to the top of the central structure and lid. The inner flexible material is selected to deform easily under mild hand pressure (e.g. 5 Newtons or less), and thus when the user applies force to the straw, the inner flexible material distorts and bends allowing the user to more easily move the straw around and mix the contents of user's drink.

DETAILED DESCRIPTION OF THE INVENTION

Figure 1:
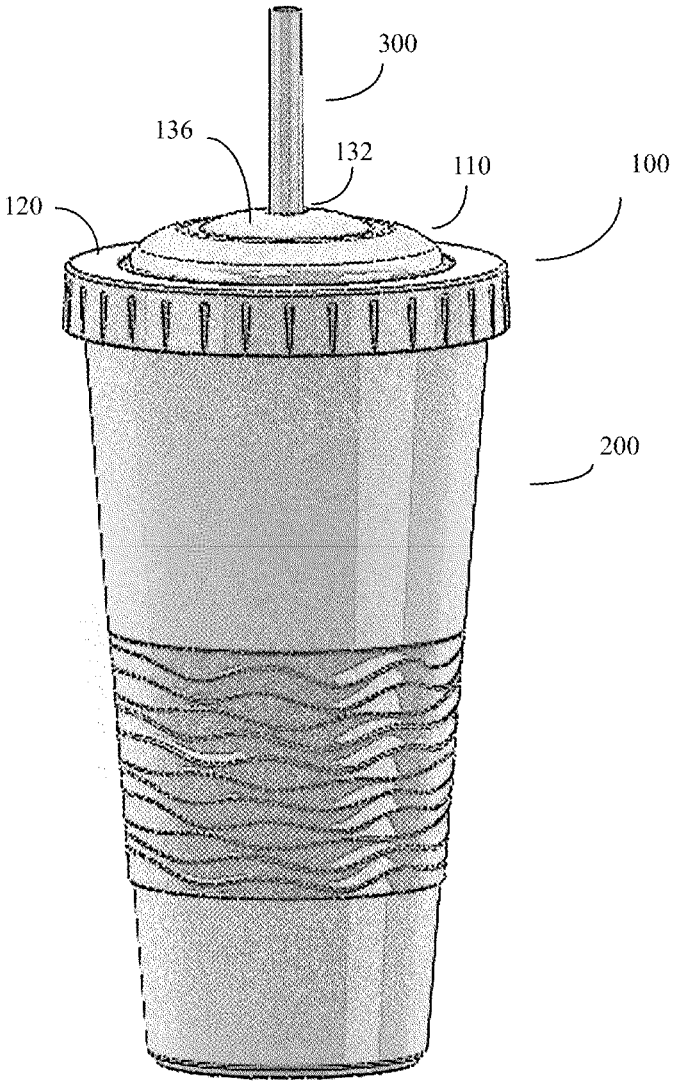
FIG. 1 shows the flexible membrane drinking cup lid attached to a drinking cup, with a drinking straw passing through the opening of the central structure.

As shown in FIG. 1, the invention may be a lid device (100) for a beverage cup (200), such as a substantially cylindrical beverage cup. This lid device will typically comprise an annular structure comprising an inner flexible material (110) surrounded by an outer ring (120) of substantially rigid material. This outer ring is typically configured to reversibly attach to a rim (202) of a beverage cup (200).

In some embodiments, this inner flexible material (110) will surround a central structure (130), typically comprising an opening (132) with an axis (134) that, in the absence of applied force (see FIG. 4B, 302), is substantially perpendicular to a top surface (136) of this central structure (130).

The inner flexible material (110) may often comprise an elastomeric polymer, such as silicone, other thermoplastic elastomer (TPE), thermoplastic rubber (TPR), or similar type material that is typically solid at room temperature, but which is capable of elongating by at least 200% before breaking.

The outer ring of substantially rigid material (120) (optionally the central structure 130 may also comprise a substantially rigid material) may comprises polystyrene (PS) or other substantially rigid plastic such as acrylonitrile butadiene styrene (ABS), polypropylene (PP), acrylonitrile styrene (AS), styrene acrylonitrile resin (SAN), polyethylene terephthalate glycol (PTEG), copolyester resins, and the like that are relatively rigid (e.g. capable of elongating less than 10% before breaking).

In some embodiments, the lid may also comprise a central structure comprising an inner disk (130), surrounded by the inner flexible material. This inner disk may itself further comprise a substantially rigid inner material, which may be the same or different substantially rigid material used for the outer ring (120). This optional rigid inner disk may be attached on an outer perimeter of the inner disk to the inner flexible material (110).

Thus FIG. 1 shows the flexible membrane drinking cup lid (100) attached to a drinking cup (200), with a drinking straw (300) passing through the opening (132) of the central structure (130).

Figure 2:
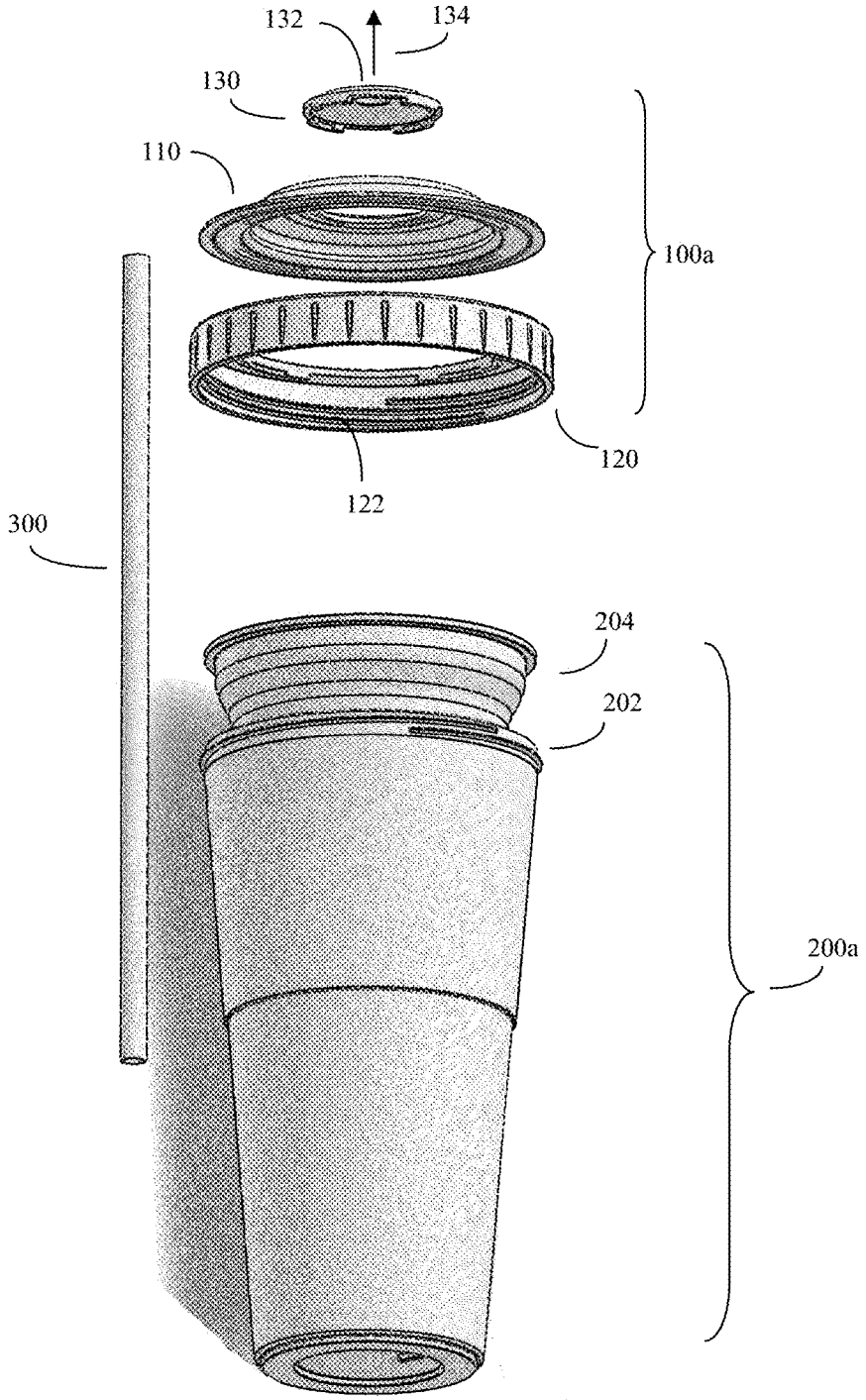
FIG. 2 shows an exploded version of one embodiment of the flexible membrane drinking cup lid, here shown with an exploded drawing of a particular drinking cup version. Here the drinking straw is shown separately.

FIG. 2 shows an exploded version of one embodiment of the flexible membrane drinking cup lid (100*a*), here shown with an exploded drawing of a particular drinking cup version (200*a*).

Here the drinking cup has an optional inner liner (204). The drinking straw (300) is shown separately.

In the embodiment shown in FIG. 2, the inner flexible material (110) can comprise a 1.5 millimeter thick silicon membrane. The outer ring of substantially rigid material can comprise 2.3 millimeter thick acrylonitrile styrene, and the optional rigid inner disk (130) can comprise 2.2 millimeter thick acrylonitrile styrene. The device may also comprise various gaskets to help attach the various materials together (not shown).

This opening (132) will often be a circular opening with a radius or largest dimension designed to fit most common drinking straws (which typically have a radius between about 1 millimeter and about 4 millimeters) without a lot of excess space. To do this, the radius of opening (132) will often be between 1 and 2 times the radius this typical drinking straw (300). Thus the radius of opening (132) will often be between 1 millimeter and 8 millimeters. However other designs, intended to fit jumbo straws with a radius larger than 4 millimeters, may also be employed.

The central structure (130) will typically have a top surface (136) that is facing away from the drinking cup (200). This central structure will typically be configured to allow the drinking straw (300) to pass through the central structure (via the opening 132) and into the interior of the beverage cup (200). There the lower part of the straw can be used to stir the user's drink.

In some embodiments, the outer ring (120) may further comprise any of snaps or threading (122) to facilitate reversible attachment of the outer ring to the rim (202) of the beverage cup.

Figure 3B:
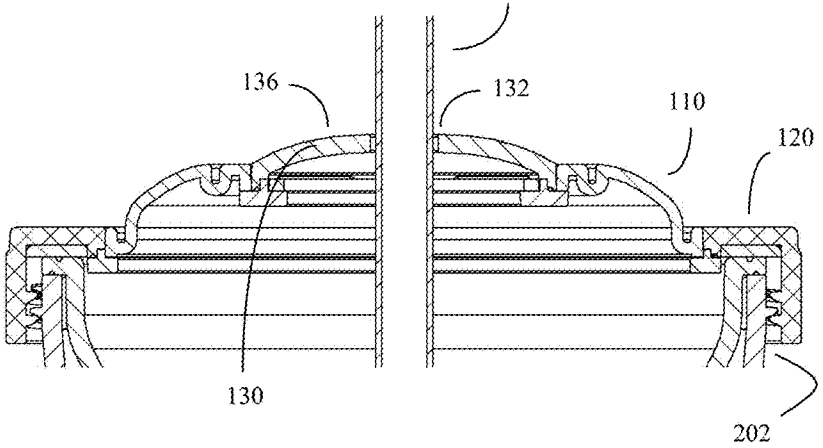
FIG. 3B shows a cross section of the top of the flexible membrane drinking cup lid, showing how the drinking straw passes through the opening of the central structure and into the main body of the drinking cup.
Figure 3A:
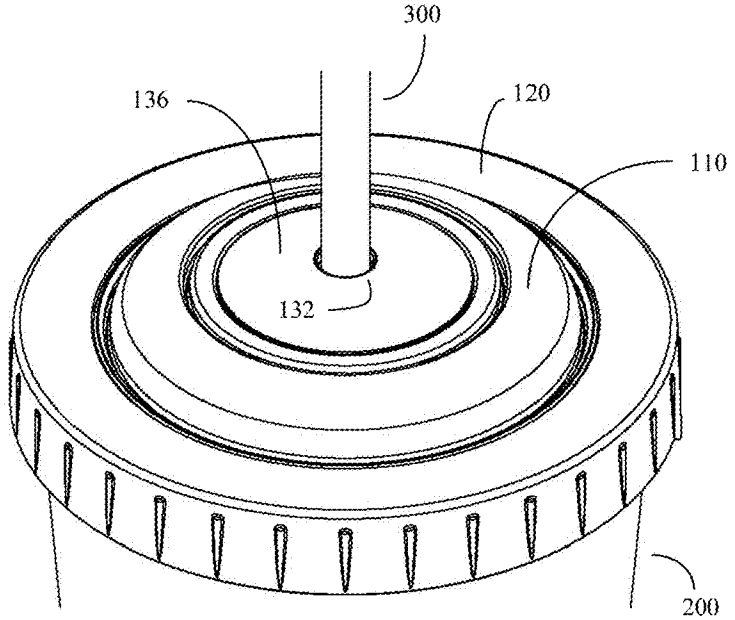
FIG. 3A shows a close up of the top of the flexible membrane drinking cup lid, showing a detail of how the drinking straw passes though the opening of the central structure.

FIG. 3A shows a close up of the top of the flexible membrane drinking cup lid, showing a detail of how the drinking straw (300) passes though the opening (132) of the central structure (130, 136).

FIG. 3B shows a cross section of the top of the flexible membrane drinking cup lid, showing how the drinking straw (300) passes through the opening (132) of the central structure (130, 136) and into the main body of the drinking cup.

As shown in FIGS. 4A-5B, the inner flexible material (110) and the central structure (130, 136) are typically further configured to allow a human user of the drinking straw (300), pushing on the straw with a hand force, often a relatively small hand force of 5 Newtons or less (302) to move the straw to mix the drink. More specifically, due to the flexible membrane material, this hand force can either displace the orientation (angle) (306) of the axis (134) by at least +/−20 degrees from a no-force resting state, and/or displace the location (304) of the opening (132) by at least 2× (two times) the radius of the drinking straw (300) from a no-force resting state.

Figure 4B:
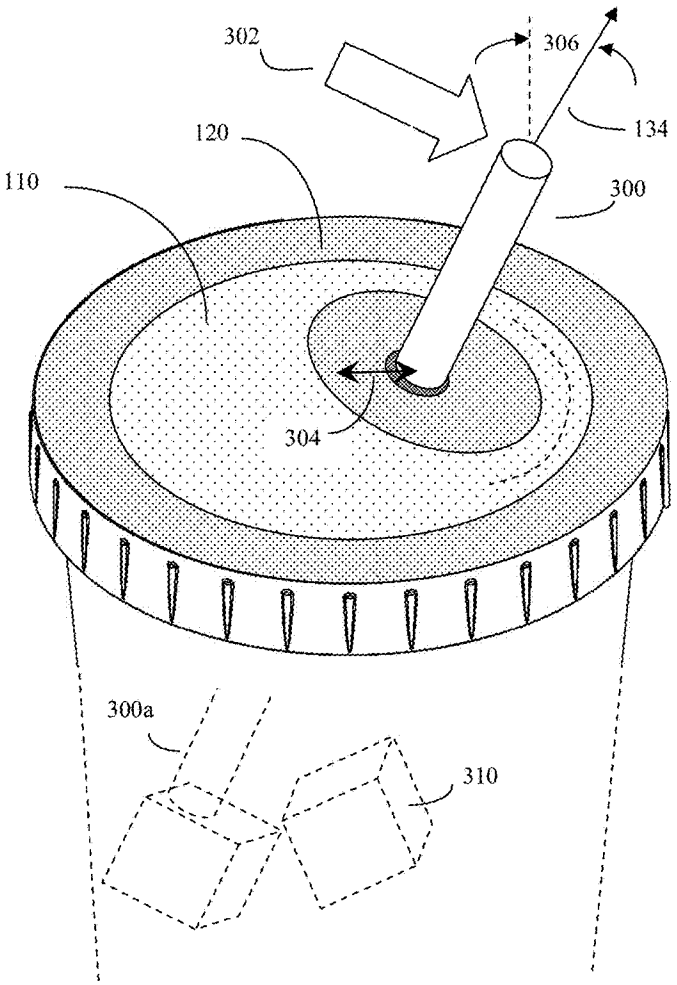
FIG. 4B shows a close up of the top of the flexible membrane drinking up lid, showing how the application of a small amount of force by the human user can cause the flexible membrane to deform, resulting in displacement of the central structure and drinking straw from its resting position shown in FIG. 4A, as well as a change in the main axis of the central structure and drinking straw.
Figure 4A:
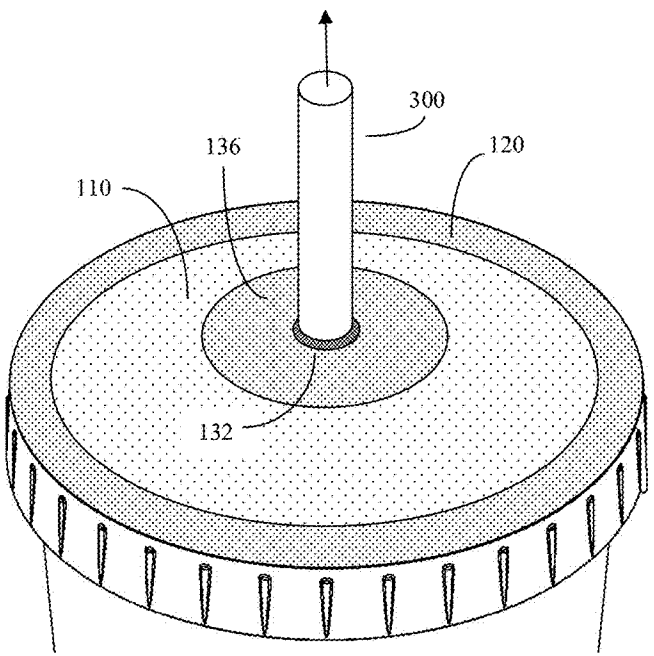
FIG. 4A shows a close up of the top of the flexible membrane drinking cup lid, with a straw passing though the opening of the central structure, when no force is applied to the straw.

FIG. 4A shows a close up of the top of the flexible membrane drinking cup lid, with a straw (300) passing though the opening (132) on the central structure (130, 136), when no force is applied to the straw.

FIG. 4B shows a close up of the top of the flexible membrane drinking up lid, showing how the application of a small amount of force by the human user (302) can cause the flexible membrane (110) to deform, resulting in displacement of the central structure (304) and drinking straw (300) from its resting position shown in FIG. 4A, as well as a change (306) in the angle of the main axis (134) of the central structure and drinking straw.

FIG. 4B also shows how the invention can allow a user to stir the user's drink, and/or play with ice cubes or other objects in the user's drink. Here the extension of the drinking straw into the cup is shown as (300*a*), and some ice cubes in the cup are shown as (310). The invention allows the user to move the location and direction of the straw, thus stirring the drink and/or any objects in the drink.

Unlike prior art such as Serra, however, according to the present invention, the inner flexible materials, outer ring of substantially rigid material, and central structure are securely attached to each other so as to prevent rotation of any of the inner flexible material, substantially rigid material, or central structure relative to each other.

Various methods may be used to securely attach the inner flexible material to the substantially rigid material and/or central structure in a non-rotatable manner. These methods can include gluing, snap fitting, sonic welding, and the like. Gaskets and pressure fitting methods may also be used. Alternatively the combination of the rigid plastic (substantially rigid material) and the softer rubber or elastomeric material (inner flexible material) can be produced by an overmolding or co-molding process, where an additional second material is added over a previously existing first material. This can produce an apparently single part with different sections deriving from different materials.

Alternative Embodiments

In some embodiments, the central structure need not comprise a substantially rigid inner material. For example, the central structure can comprise, or even consist of, as little as the inner flexible material (110) and the opening (132).

Figure 5B:
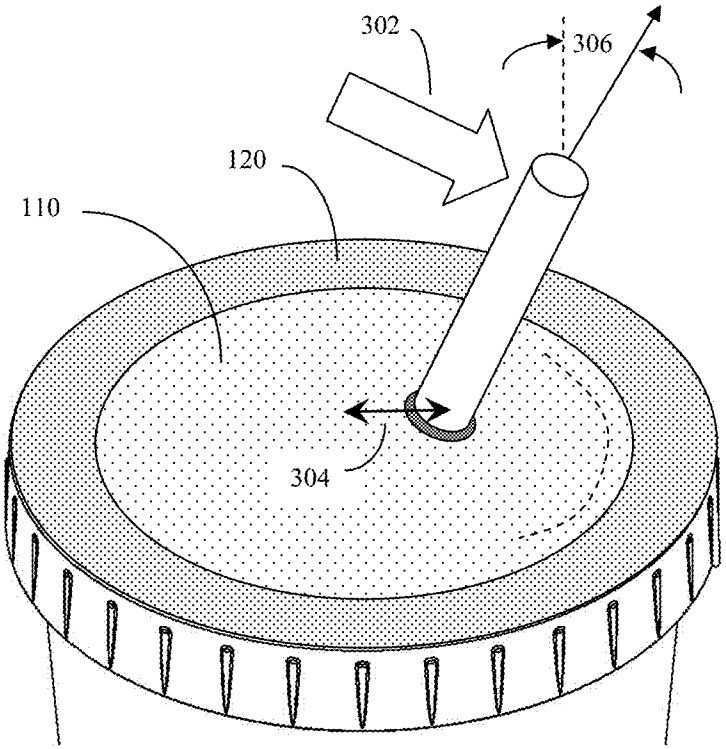
FIG. 5B shows a close up of the top of the flexible membrane drinking up lid previously shown in FIG. 5A, again showing the effect of the application of a small amount of force by the human user upon the straw. Again the straw is displaced and/or has a change in angle.
Figure 5A:
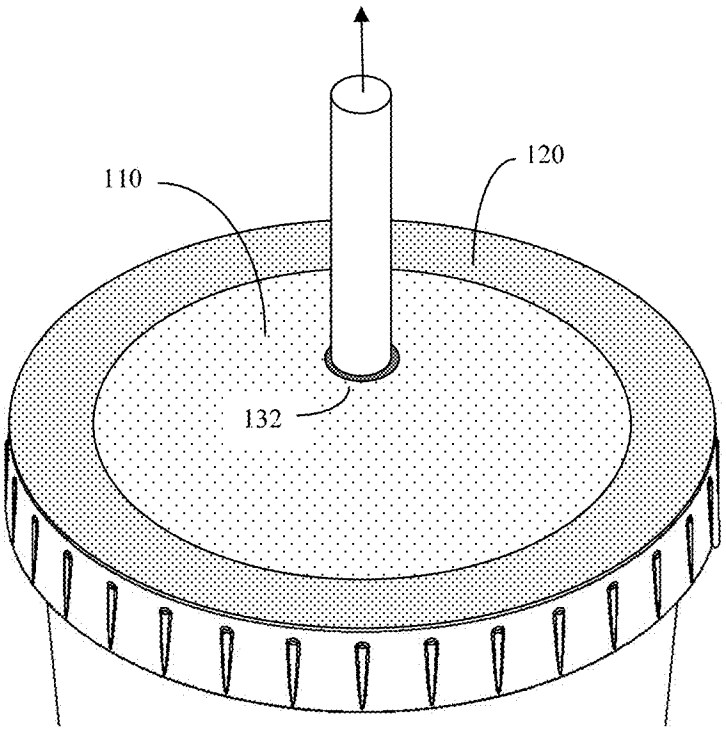
FIG. 5A shows a close up of the top an alternate embodiment of the flexible membrane drinking cup lid, where the central structure does not also comprise an inner disk of substantially rigid inner material. Instead the central structure merely comprises the inner flexible material and the opening for the straw. Here again, no force is being applied to the straw.

FIG. 5A shows a close up of the top of an alternate embodiment of the flexible membrane drinking cup lid, where the central structure does not also comprise an inner disk of substantially rigid inner material (130). Instead the central structure merely comprises the inner flexible material (110) and the opening (132) for the straw. Here again, no force is being applied to the straw.

FIG. 5B shows a close up of the top of the flexible membrane drinking up lid previously shown in FIG. 5A, again showing the effect of the application of a small amount of force (302) by the human user upon the straw. Again the opening (132) and the straw (300) are displaced (304) and/or have a change in angle (306).

Although in some embodiments, the inner flexible material may be a single piece of an elastomeric polymer, in other embodiments, various gaskets, which may also be made of flexible materials, may be used to help attach the inner flexible material to the substantially rigid material.

The invention claimed is:

1. A lid device for a beverage cup, said device comprising:

an annular structure comprising an inner flexible material surrounded by an outer ring of substantially rigid material, said outer ring configured to reversibly attach to a rim of a beverage cup;

said inner flexible material having a central structure, said central structure comprising an opening with an axis that, in the absence of applied force, is substantially perpendicular to a top surface of said central structure;

said central structure configured to allow a drinking straw to pass through said central structure and into an interior of said beverage cup, said drinking straw comprising a radius;

said opening further comprising an opening radius between 1 and 2 times said radius of said drinking straw;

said inner flexible material and said central structure further configured to allow a human user of said straw, using a hand force of 5 Newtons or less on said drinking straw, to displace any of:

a: an orientation of said axis by at least +/−20 degrees from a no force resting state;

b: a location of said opening by at least 2× said radius of said drinking straw from a no force resting state;

wherein said inner flexible materials, said outer ring of substantially rigid material, and said central structure are securely attached to each other so as to prevent rotation of any of said inner flexible material, substantially rigid material, or central structure relative to each other.

2. The device of claim 1, wherein said drinking straw has a radius between 1 millimeter and 4 millimeters.

3. The device of claim 1, wherein said inner flexible material comprises an elastomeric polymer capable of elongating by at least 200% before breaking.

4. The device of claim 3, wherein said elastomeric polymer comprises silicone or other thermoplastic elastomer or thermoplastic rubber.

5. The device of claim 1, wherein said substantially rigid material comprises any of polystyrene, acrylonitrile butadiene styrene, polypropylene, acrylonitrile styrene, styrene acrylonitrile resin, polyethylene terephthalate glycol, copolyester resin, or other substantially rigid plastic capable of elongating less than 10% before breaking.

6. The device of claim 1, wherein said central structure also comprises said inner flexible material, and wherein said central structure consists of said opening.

7. The device of claim 1, wherein said central structure comprises an inner disk of substantially rigid inner material that is attached on an outer perimeter of said inner disk to said inner flexible material.

8. The device of claim 7, wherein said substantially rigid inner material comprises any of polystyrene acrylonitrile butadiene styrene, polypropylene, acrylonitrile styrene, styrene acrylonitrile resin, polyethylene terephthalate glycol, copolyester resin, or other substantially rigid plastic capable of elongating less than 10% before breaking.

9. The device of claim 1, wherein said outer ring further comprises any of snaps or threading to facilitate reversible attachment of said outer ring to said rim of said beverage cup.

* * * * *